US007150060B1

(12) United States Patent
Wu

(10) Patent No.: US 7,150,060 B1
(45) Date of Patent: Dec. 19, 2006

(54) NEST-LIKE AIR MATTRESS

(76) Inventor: Shin-Tsai Wu, 1F., No. 19, Alley 3, Lane 106, Sec. 3, Min Chuan East Rd., Taipei (TW)

( * ) Notice: Subject to any disclaimer, the term of this patent is extended or adjusted under 35 U.S.C. 154(b) by 0 days.

(21) Appl. No.: 11/171,424

(22) Filed: Jul. 1, 2005

(51) Int. Cl.
*A47C 27/10* (2006.01)

(52) U.S. Cl. ..... 5/713; 5/710; 5/711

(58) Field of Classification Search ..... 5/706, 5/710–713, 731, 733
See application file for complete search history.

(56) References Cited

U.S. PATENT DOCUMENTS 779,576 A * 1/1905 Perryman ..... 5/710
1,285,391 A * 11/1918 Robertson ..... 5/706
2,039,289 A * 5/1936 Bergeron ..... 5/710
4,826,715 A * 5/1989 Lee ..... 428/64.1
5,918,336 A * 7/1999 Lee et al. ..... 5/713
6,591,437 B1 * 7/2003 Phillips ..... 5/713

* cited by examiner

*Primary Examiner*—Michael Trettel
(74) *Attorney, Agent, or Firm*—Leong C. Lei

(57) ABSTRACT

A nest-like mattress is disclosed. The mattress comprises a multiple compartments and a nest-like fitting characterized in that the multiple inner compartments are soft, air-filled sac structure and are fitted within an individual cavity of the nest-like fitting, each air-filled inner compartment is provided with an independent nozzle, and the inner compartment has a pulling strap which allows mounting at corresponding cavity of the nest-like fitting, the nest-like fitting is provided with a plurality of cavities and each cavity allows an inner compartment and the air-filled inner compartments are located on the individual cavity, the lateral side opening of the fitting is provided with a covering cloth, the edge of the covering cloth and that of the fitting are mounted with zip or fastening/button member so as to close the side opening.

1 Claim, 8 Drawing Sheets

NEST-LIKE AIR MATTRESS

BACKGROUND OF THE INVENTION (a) Technical Field of the Invention

The present invention relates to an air mattress, and in particular, an air mattress having a plurality of inner compartments and nest-like fittings, and each of the compartments is an independent member.

(b) Description of the Prior Art

FIG. 1 shows a conventional air mattress A1 that is a fully sealed air chamber A11. A pulling rim A2 is mounted at the bottom of the bed. The pulling rim A2 prevents an air-filled mattress from expansion. The conventional air mattress does not provide balanced support to the bed and therefore one side of the mattress A1 will depress at one side subsequently. In view of the above, the air mattress will cause an abnormal sleeping position.

SUMMARY OF THE INVENTION

The primary purpose of the present invention is to provide an air mattress having multiple compartments and a nest-like fitting characterized in that the multiple inner compartments are soft, air-filled sac structures and are fitted within an individual cavity of the nest-like fitting, each air-filled inner compartment is provided with an independent nozzle, and the inner compartment has a pulling strap which allows mounting at corresponding cavity of the nest-like fitting, the nest-like fitting is provided with a plurality of cavities and each cavity allows an inner compartment and the air-filled inner compartments are located on the individual cavity, the lateral side opening of the fitting is provided with a covering cloth, the edge of the covering cloth and that of the fitting are mounted with zip or fastening/button member so as to close the side opening.

Yet still another object of the present invention is to provide a nest-like air mattress, wherein the lateral side of the nest-like fitting is provided with a pressure controlled valve and an air-pump, which is connected to each of the inner compartment by a specifically fitted soft air delivery tube.

Another object of the present invention is to provide a nest-like air mattress, wherein the inner compartment has a square tube shape, and the compartments are arranged in a single layer or a multiple layer to form a single layered or multiple layered mattress.

A further object of the present invention is to provide a nest-like air mattress, wherein the inner compartment has an elongated shape, and the compartments are arranged in a single layer or a multiple layer to form a single layered or multiple layered mattress.

A further object of the present invention is to provide a nest-like air mattress, wherein the configuration structure and the application include 1. Change of configuration
2. Structure change: The inner compartments are provided with pulling strap which could prevent inflation of the compartments. Thus, the inner compartment provides the required shape.
3. Change of application: The inner compartment is fitted with a soft tube connected to a pressure-controlled valve, which connects to an air pump such that the height of the bed can be adjusted.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
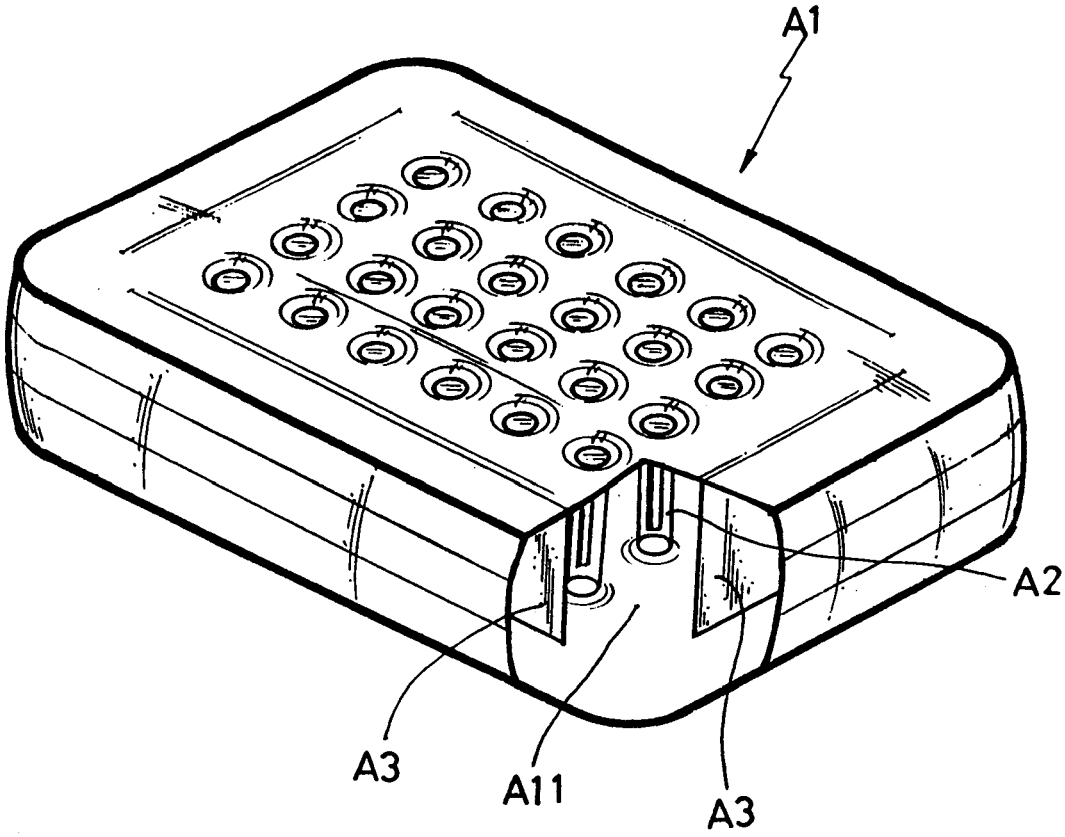
PRIOR ART FIG. 1
FIG. 1 is a sectional view of a conventional air mattress.
Figure 2:
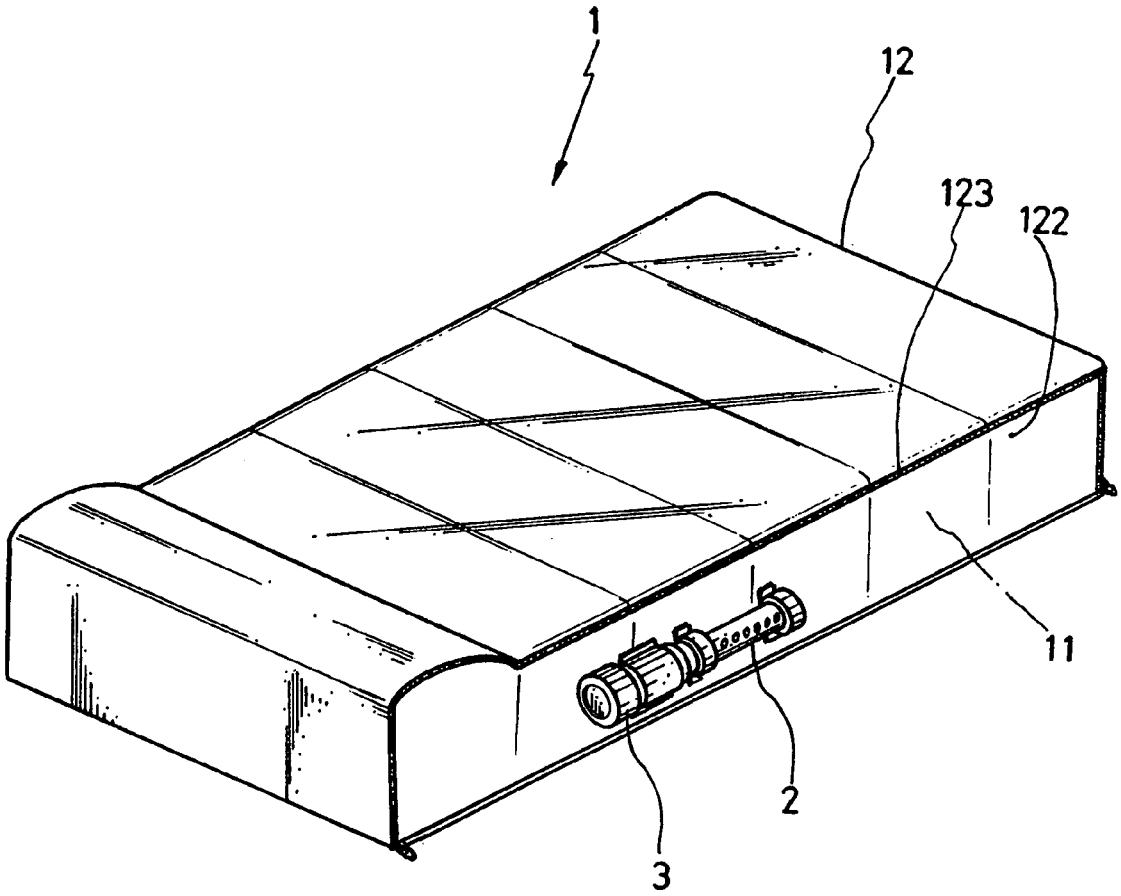
FIG. 2 is a perspective view of an air mattress of the present invention.
Figure 3:
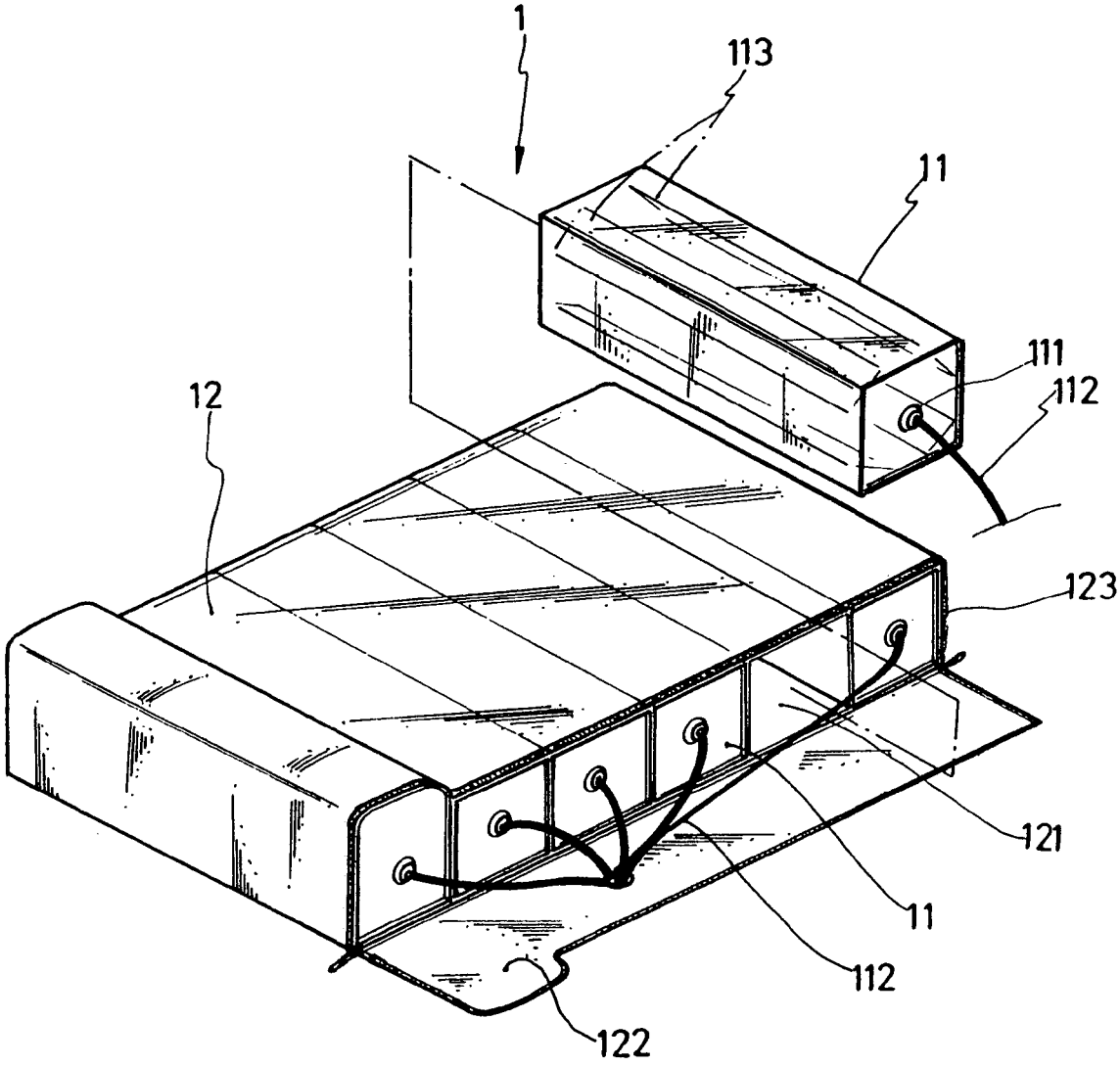
FIG. 3 is a schematic view showing individual components of the air mattress of the present invention.

Referring to FIGS. 2 and 3, the air mattress 1 includes a plurality of inner compartments 11 and a nest-like fitting 12. The inner compartments 11 are a soft air-filled sac body which can be mounted on each of the cavity 121 of the fitting 12. Each of the air-filled compartments 11 has an independent nozzle 111 for air filling or for air releasing. In practice, the fitting 12 is provided with a pressure-controlled valve 2 and an air pump 3, at one lateral side of the fitting 12. Each of the inner compartments 11 has a specific soft air delivery hose 112 linked to the air pump 3. Thus, each of the compartments 11 can be effectively adjusted for air filling or air releasing.

As shown in FIG. 3, the inner compartment 11 is provided at the individual cavity 121 of the fitting 12, and when the compartments 11 are filled with air, the compartments are placed into the cavity 121. The inner compartment 11 is firmly fitted to the entire inner compartment 11 and the bed is supported. The end face of the inner compartment 11 at one lateral side of the fitting 12 is a covering cloth 122, which has an edge, is fastened with a zipper 123 or button or pin with the edge of the fitting 12 such that the end face of the fitting 12 is covered. Each of the inner compartments 11 is connected to the pressure-controlled valve 2 and the air pump 3 by means of a soft delivery hose 112.

Figure 4:
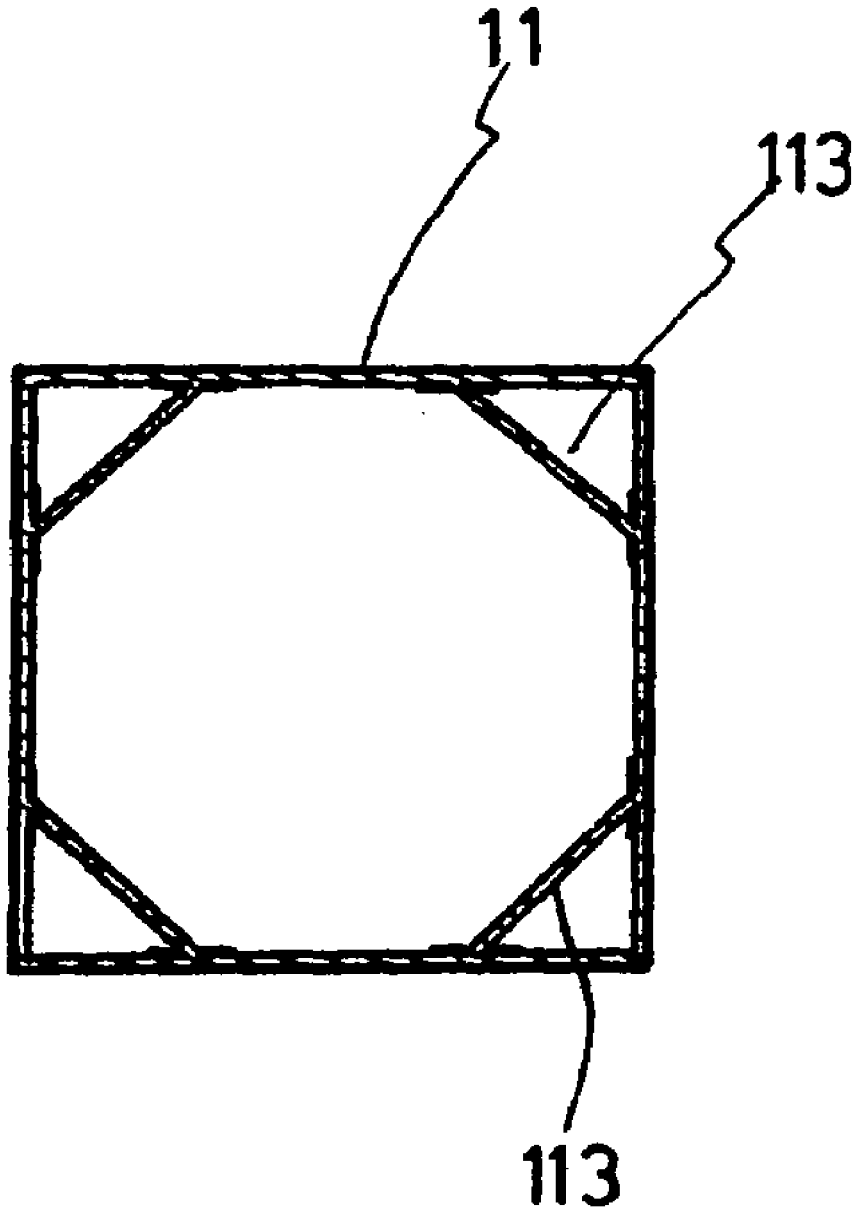
FIG. 4 is a sectional view showing the air inner compartment of the air mattress of the present invention.

As shown in FIG. 4, the inner compartment 11 is square and tubular shaped which is provided with a diagonal pulling strap 113. By pulling the strap 113, the inner compartment 11 forms into square shape to fit the square cavity 121 of the fitting 12.

Figure 5:
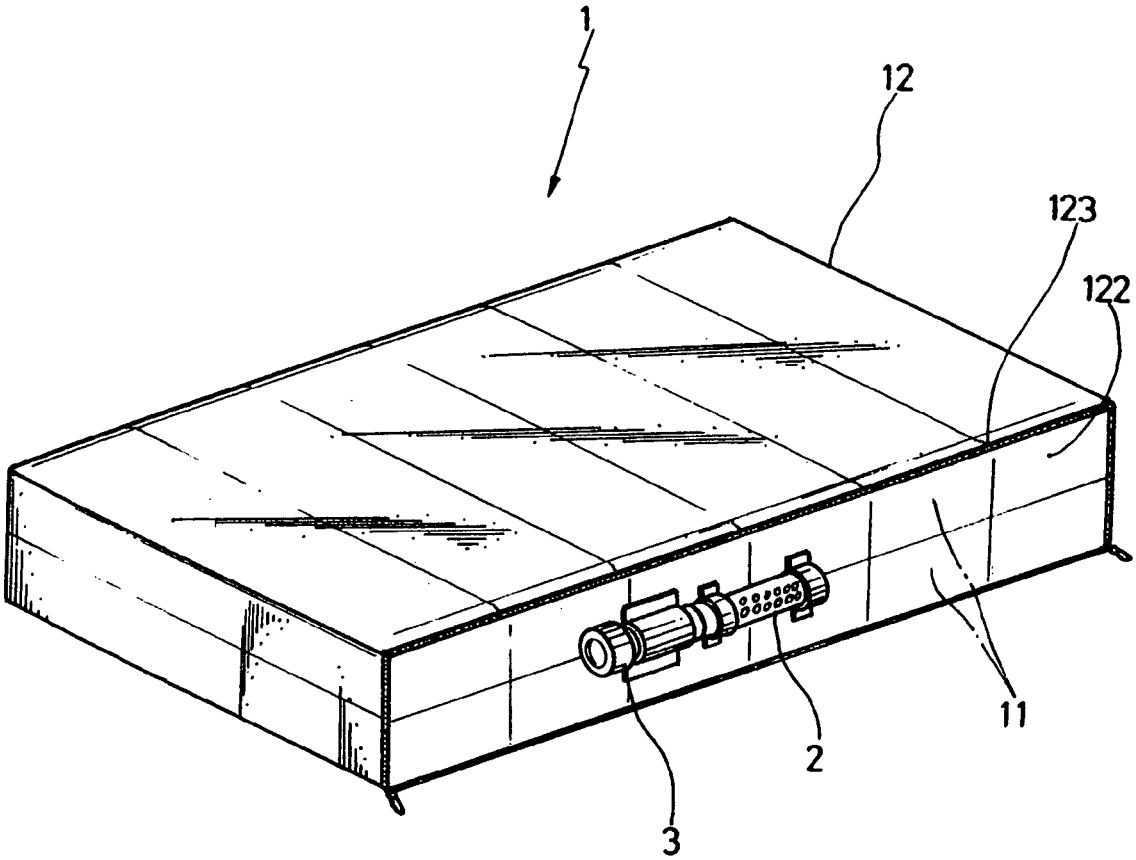
FIG. 5 is a perspective view of another preferred embodiment in accordance with the present invention.
Figure 6:
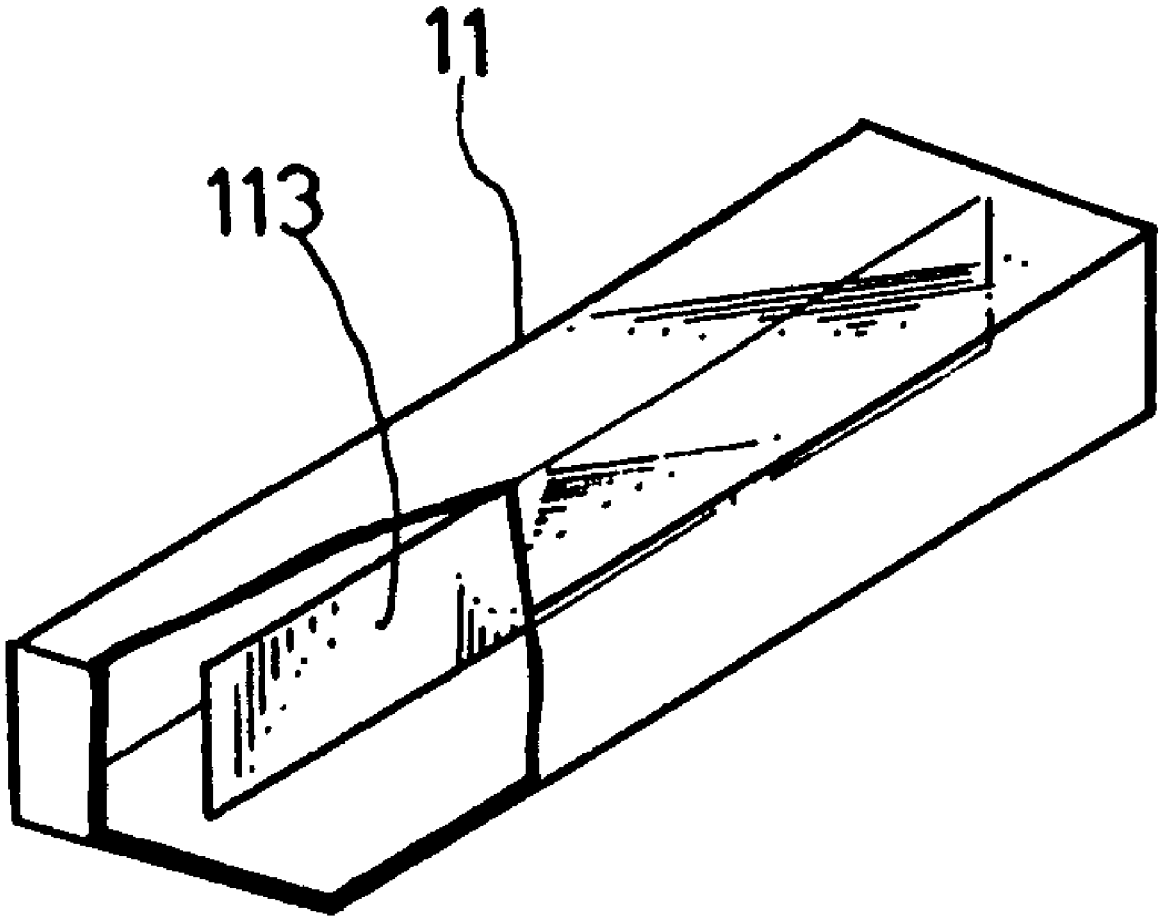
FIG. 6 is a sectional view of the air inner compartment of FIG. 5 of the present invention.
Figure 7:
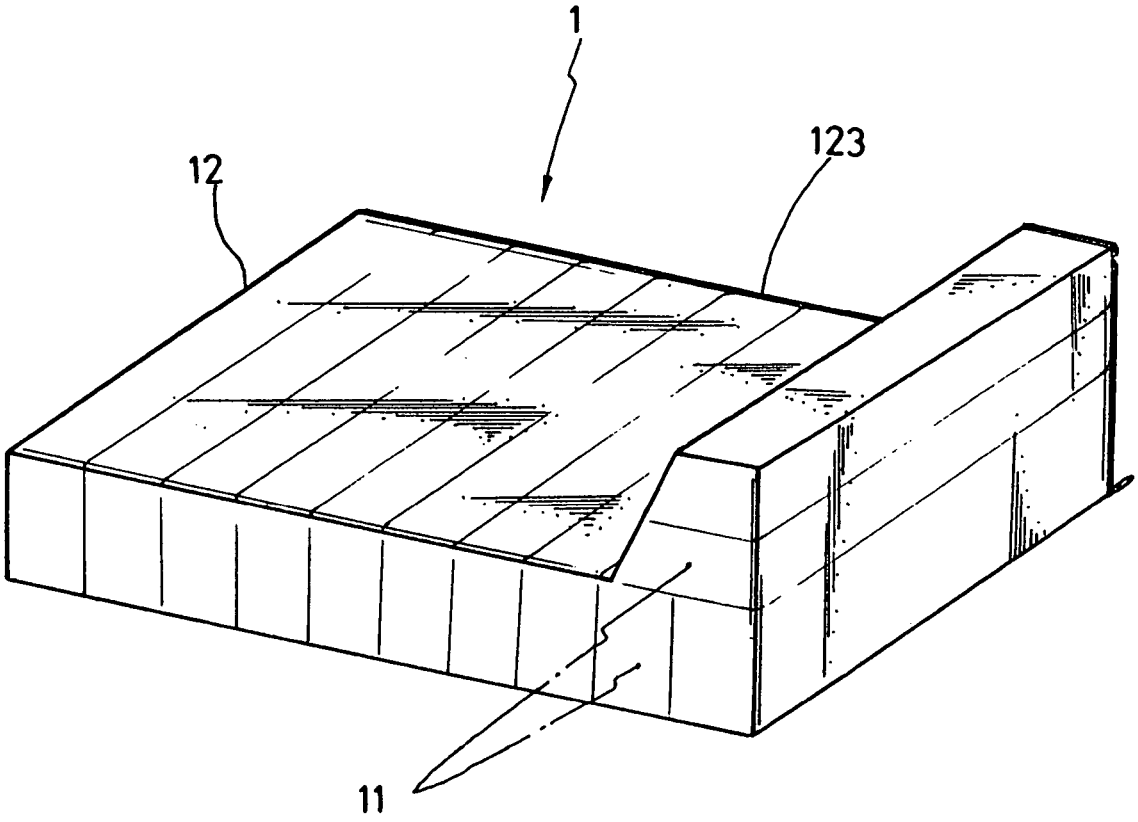
FIG. 7 is a perspective view of another preferred embodiment of the present invention.

Referring to FIG. 5, there is shown another preferred embodiment of the present invention. In this preferred embodiment, the inner compartment 11 is rectangular elongated tubular shaped. There is a vertical direction pulling strap 113 which can be pulled so as to provide air to the inner compartment 11 to fit the required shape of the cavity, as shown in FIG. 6.

Figure 8:
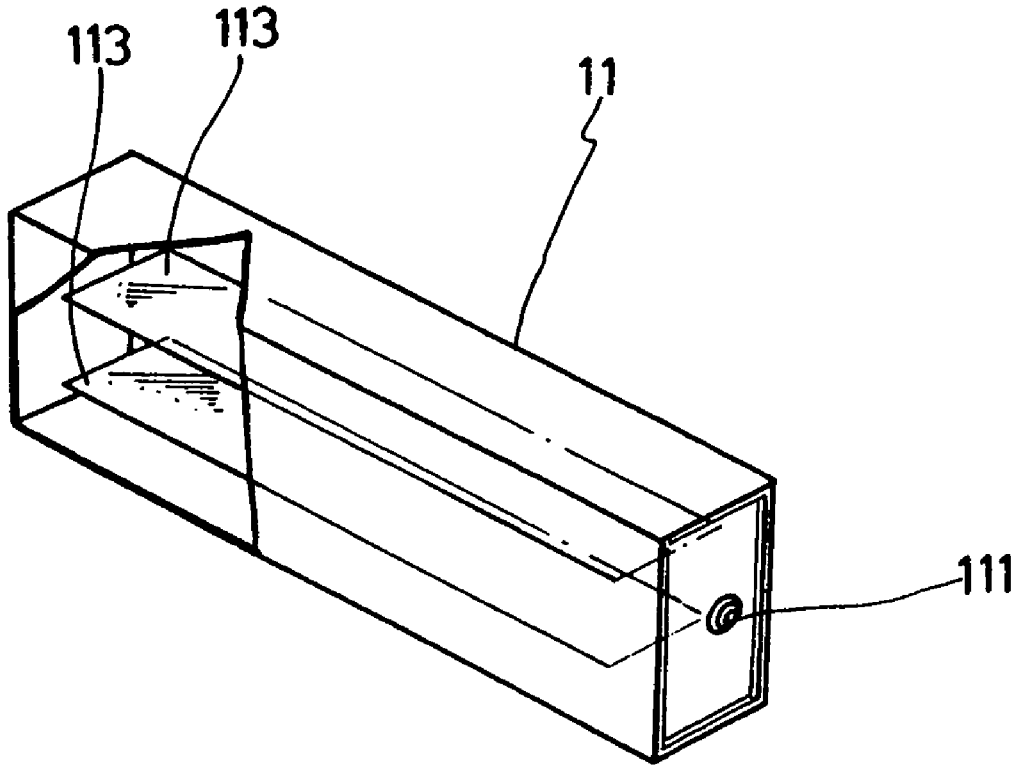
FIG. 8 is a sectional view of the air inner compartment of FIG. 7 of the present invention.

Referring to FIG. 5, the cavity 121 is a single horizontal, and the interior of the inner compartment, a horizontal pulling strap 113 is provided. If the pulling strap 113 is pulled, the inner compartment 11 is filled with air and the inner compartment 11 fits the rectangular or elongated cavity 121, as shown in FIG. 8.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An air mattress comprising:

a plurality of inner compartments which are a soft air-filled sac body, each of said inner compartments having an independent nozzle for air filling or air releasing, each of said inner compartments having a soft air delivery hose, each of said inner compartment being square and tubular shaped and provided with a diagonal pulling strap, an outermost one of said inner compartment having an arch-shaped upper side serving as a pillow;

a fitting having a plurality of cavities, said fitting being provided with a pressure-controlled valve and an air pump, said pump being linked to said hose, an lateral side of said fitting being provided with a covering cloth which has an edge fastened with a zipper for zipping said fitting closed; and each of said inner compartments being fitted in a respective one of said cavities of said fitting, each of said inner compartments being connected to said pressure-controlled valve and said air pump via a soft delivery hose.

* * * * *